US011110718B2

(12) United States Patent
Nakamura et al.

(10) Patent No.: US 11,110,718 B2
(45) Date of Patent: Sep. 7, 2021

(54) LIQUID EJECTING APPARATUS

(71) Applicant: SEIKO EPSON CORPORATION, Tokyo (JP)

(72) Inventors: Hiroyuki Nakamura, Shiojiri (JP); Ayumi Yokoo, Matsumoto (JP); Kazuhiko Sato, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/725,275

(22) Filed: Dec. 23, 2019

(65) Prior Publication Data

US 2020/0207110 A1 Jul. 2, 2020

(30) Foreign Application Priority Data

Dec. 26, 2018 (JP) ..... JP2018-242245

(51) Int. Cl.
*B41J 2/175* (2006.01)
*B41J 2/14* (2006.01)

(52) U.S. Cl.
CPC ..... *B41J 2/17596* (2013.01); *B41J 2/14201* (2013.01); *B41J 2002/14306* (2013.01)

(58) Field of Classification Search
CPC . B41J 2/01; B41J 2/175; B41J 2/17596; B41J 2/14201; B41J 2002/14306
See application file for complete search history.

(56) References Cited

U.S. PATENT DOCUMENTS 8,147,044 B2 * 4/2012 Yokouchi ..... B41J 2/175 347/85
8,746,840 B2 * 6/2014 Kurebayashi ..... B41J 2/16505 347/32
9,393,793 B2 * 7/2016 Nakamura ..... B41J 2/175
2009/0085991 A1 * 4/2009 Karppinen ..... B41J 2/16552 347/85
2009/0179974 A1 * 7/2009 Kimura ..... B41J 2/17509 347/85
2015/0224786 A1 * 8/2015 Otsuka ..... B41J 2/18 347/92

FOREIGN PATENT DOCUMENTS

JP S62290544 12/1987
JP 2005199551 7/2005
JP 2012106373 6/2012
JP 2017077705 4/2017

* cited by examiner

*Primary Examiner* — Anh T Vo
(74) *Attorney, Agent, or Firm* — Workman Nydegger

(57) ABSTRACT

A liquid ejecting apparatus includes a liquid ejecting head configured to eject a liquid, a liquid supply flow path configured to supply the liquid from a liquid container containing the liquid to the liquid ejecting head, a pressurizing portion pressurizing an inside of the liquid supply flow path, and an solenoid valve which is provided in the liquid supply flow path and which opens the liquid supply flow path during energization and closes the liquid supply flow path during de-energization, in which open and closed states of the solenoid valve are forcibly switched in accordance with a pressure change by the pressurizing portion.

9 Claims, 12 Drawing Sheets

LIQUID EJECTING APPARATUS

The present application is based on, and claims priority from JP Application Serial Number 2018-242245, filed Dec. 26, 2018, the disclosure of which is hereby incorporated by reference herein in its entirety.

BACKGROUND

1. Technical Field

The present disclosure relates to a liquid ejecting apparatus such as a printer.

2. Related Art

For example, as disclosed in JP-A-2005-199551, there is a printing apparatus which is an example of a liquid ejecting apparatus printing by spraying ink which is an example of a liquid from a print head which is an example of a liquid ejecting head. The printing apparatus includes a supply control unit that controls a supply of ink. The supply control unit opens a solenoid valve, which is an example of a solenoid valve provided in a supply pipe which is an example of a liquid supply flow path and supplies pressurized ink enclosed in an ink cartridge to the print head.

For example, when a control signal is not properly output from the supply control unit, the solenoid valve does not properly open and close. In particular, there was a concern that pressurized ink would continue to be supplied and a large amount of ink would leak from the print head when the solenoid valve was not properly closed.

SUMMARY

According to an aspect of the present disclosure, there is provided a liquid ejecting apparatus including a liquid ejecting head configured to eject a liquid, a liquid supply flow path configured to supply the liquid from a liquid container containing the liquid to the liquid ejecting head, a pressurizing portion pressurizing an inside of the liquid supply flow path, a solenoid valve which is provided in the liquid supply flow path and which opens the liquid supply flow path during energization and closes the liquid supply flow path during de-energization, in which open and closed states of the solenoid valve are forcibly switched in accordance with a pressure change in the pressurizing portion.

DESCRIPTION OF EXEMPLARY EMBODIMENTS

First Embodiment

In the following, an embodiment of a liquid ejecting apparatus will be described with reference to the drawings. The liquid ejecting apparatus is, for example, an ink jet printer printing by ejecting ink, which is an example of a liquid, onto a medium such as a paper sheet.

Figure 1:
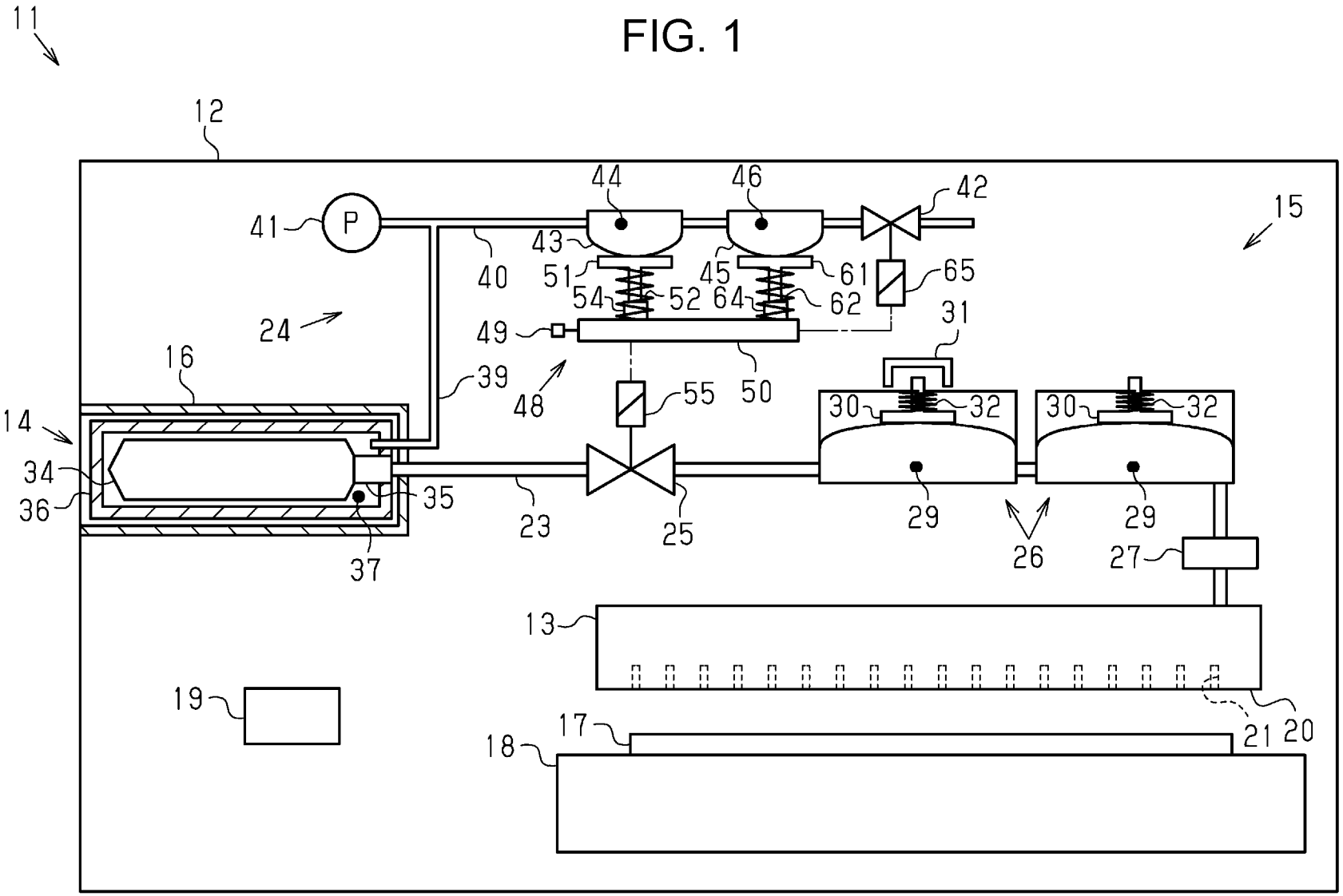
FIG. 1 is a schematic view of a liquid ejecting apparatus of a first embodiment.

As shown in FIG. 1, the liquid ejecting apparatus 11 includes a housing 12. The liquid ejecting apparatus 11 includes a liquid ejecting head 13 configured to eject a liquid and a liquid supply mechanism 15 supplying the liquid to the liquid ejecting head 13 from a liquid container 14 containing the liquid. The liquid ejecting apparatus 11 may include a mounting portion 16 in which the liquid container 14 is attachably/detachably mounted and a supporting portion 18 supporting a medium 17 to be transported. The liquid ejecting apparatus 11 includes a controller 19 configured with a processing circuit including a computer and a memory, for example. The controller 19 controls, in accordance with a program stored in the memory, various operations executed by the liquid ejecting apparatus 11.

A plurality of nozzles 21 opening on a nozzle surface 20 are formed in the liquid ejecting head 13. The liquid ejecting head 13 ejects a liquid from the nozzle 21 onto the medium 17 supported by the supporting portion 18 and prints on the medium 17. The liquid ejecting head 13 may be a serial type that ejecting a liquid while moving to print. The liquid ejecting head 13 may be a line type that is provided long in the width direction of the medium 17 and that ejects a liquid onto the transported medium 17 to print. The liquid ejecting apparatus 11 may include a plurality of mounting portions 16 and a plurality of liquid supply mechanisms 15 to deal with types of liquid ejected by the liquid ejecting head 13. In the present embodiment, a case will be described where the liquid ejecting apparatus 11 includes one mounting portion 16 on which one liquid container 14 is mounted and one liquid supply mechanism 15.

The liquid supply mechanism 15 includes a liquid supply flow path 23 configured to supply a liquid from the liquid container 14 to the liquid ejecting head 13, a pressurizing portion 24 pressurizing an inside of the liquid supply flow path 23, and a solenoid valve 25 provided in the liquid supply flow path 23. The liquid supply flow path 23 may include a reservoir 26 reserving a liquid and a pressure adjustment valve 27 adjusting a pressure of the liquid supplied to the liquid ejecting head 13. A plurality of reservoirs 26 may be provided in the liquid supply flow path 23. When a plurality of reservoirs 26 are provided in the liquid supply flow path 23, it is possible to reduce the size of each reservoir 26, compared to a case where one reservoir 26 is provided in the liquid supply flow path 23.

The reservoir 26 reserves liquid in a reservation chamber 29 which is a space having variable volume. The reservoir 26 includes a pressure receiver 30 receiving pressure of the liquid reserved in the reservation chamber 29, a detecting portion 31 measuring the pressure receiver 30, and a supply spring 32 pressing the pressure receiver 30 toward reducing the volume of the reservation chamber 29. When a plurality of reservoirs 26 are provided, the strength of the supply spring 32 may be different for each reservoir 26. When a plurality of reservoirs 26 are provided, the detecting portion 31 may be provided in one reservoir 26 among the plurality of reservoirs 26.

The liquid container 14 includes a containing bag 34 containing liquid, an outlet portion 35 guiding the liquid from the containing bag 34, and a case 36 covering the containing bag 34. The inside of the case 36 is a sealed air chamber 37. The containing bag 34 is contained in the air chamber 37. When the liquid container 14 is mounted in the mounting portion 16, an upstream end of the liquid supply flow path 23 is coupled to the outlet portion 35, and it is possible to supply the liquid in the liquid container 14 to the liquid ejecting head 13.

The pressurizing portion 24 includes an air flow path 39 configured to be coupled to the air chamber 37, a branching flow path 40 branching from the air flow path 39, an air feeding pump 41 feeding air to the air chamber 37 through the air flow path 39, and an atmosphere opening valve 42 provided in the branching flow path 40. The pressurizing portion 24 includes a first pressure chamber 44 of which a part of a wall surface is configured with a first displacing portion 43 which is an example of a displacing portion and a second pressure chamber 46 of which a part of a wall surface is configured with a second displacing portion 45 which is an example of a displacing portion.

The first pressure chamber 44 and the second pressure chamber 46 constitute a part of the air flow path 39 or the branching flow path 40. When the first pressure chamber 44 and the second pressure chamber 46 are provided in the branch flow path 40, the first pressure chamber 44 and the second pressure chamber 46 are provided between the air flow path 39 and the atmosphere opening valve 42. The first displacing portion 43 and the second displacing portion 45 are formed with a diaphragm, for example, and have flexibility. The first displacing portion 43 and the second displacing portion 45 deform in accordance with the pressure in the first pressure chamber 44 or the second pressure chamber 46, and their positions partially change.

The air feeding pump 41 is provided at the upstream end of the air flow path 39. The downstream end of the air flow path 39 is provided in the mounting portion 16. If the liquid container 14 is mounted in the mounting portion 16, the downstream end of the air flow path 39 is coupled to the air chamber 37. The pressurizing portion 24 drives the air feeding pump 41 to pressurize the air chamber 37 and pressurizes the liquid in the storage bag 34 from the outside of the containing bag 34. In this way, the pressure of the liquid in the liquid supply flow path 23 communicating with the containing bag 34 rises. That is, the pressurizing portion 24 pressurizes the inside of the liquid supply flow path 23 by using air.

When the air feeding pump 41 is driven, the pressure in the air flow path 39, the branching flow path 40 between the air flow path 39 and the atmosphere opening valve 42, the air chamber 37 and the liquid supply flow path 23 upstream of the pressure adjustment valve 27 rises. In the following description, the inside of the air flow path 39 and the branch flow path 40 in which the pressure rises by the driving of the air feeding pump 41 will be referred to as the inside of the pressurizing portion 24. The first pressure chamber 44 and the second pressure chamber 46 are provided inside the pressurizing portion 24. The first displacing portion 43 and the second displacing portion 45 are configured to be displaced in accordance with the pressure change in the pressurizing portion 24. The atmosphere opening valve 42 is provided to communicate the inside of the pressurizing portion 24 with the atmosphere.

The liquid ejecting apparatus 11 includes an opening mechanism 48 and a power supplying portion 49. The opening mechanism 48 forcibly switches the open and closed states of the solenoid valve 25 and the atmosphere opening valve 42 by a displacement of the first displacing portion 43 and the second displacing portion 45, and the power supplying portion 49 supplies power to the opening mechanism. The opening mechanism 48 includes a power supply circuit 50 for energizing the solenoid valve 25 and the atmosphere opening valve 42. The power supplying portion 49 may be a circuit coupling a power source provided outside the liquid ejecting apparatus 11 and the power supply circuit 50 or may be a battery supplying stored power.

The opening mechanism 48 includes a first moving member 51 moving in accordance with the displacement of the first displacing portion 43 and a first pressing spring 52 pushing the first moving member 51 toward reducing the volume of the first pressure chamber 44. The opening mechanism 48 includes a second moving member 61 moving in accordance with the displacement of the second displacing portion 45 and a second pressing spring 62 pushing the second moving member 61 toward reducing the volume of the second pressure chamber 46.

The power supply circuit 50 includes a first switch 54 which is an example of a switch and a second switch 64 which is an example of a switch. The first switch 54 and the second switch 64 switch to connect and disconnect the power supply circuit 50. The power supply circuit 50 is coupled to the power supplying portion 49, a first solenoid 55 included in the solenoid valve 25, and a second solenoid 65 included in the atmosphere opening valve 42.

Figure 2:
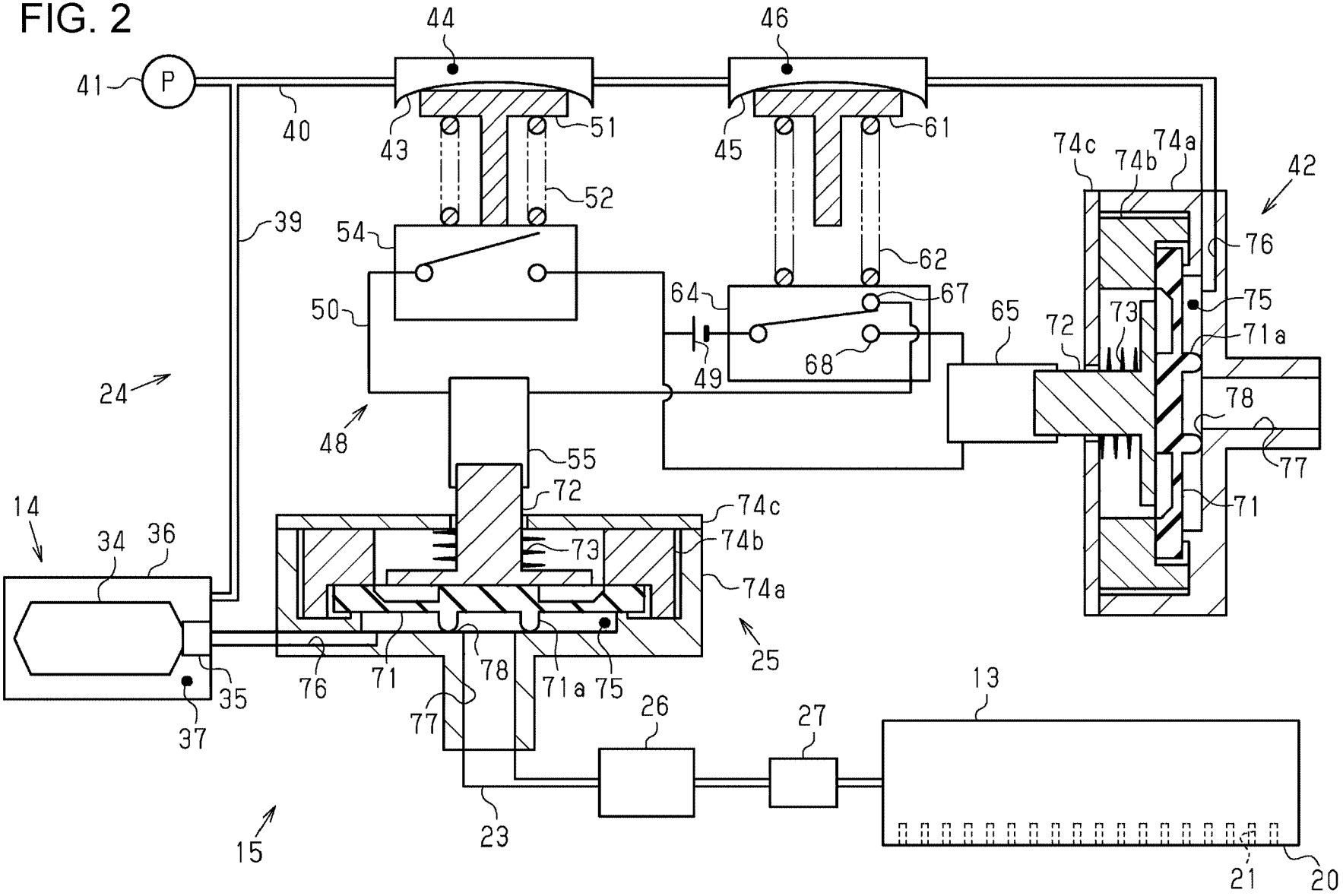
FIG. 2 is a schematic view of a liquid supply mechanism when a pressure in a pressurizing portion is lower than a supply pressure.

As shown in FIG. 2, the first switch 54 is a single-pole single-throw switch. The second switch 64 is a single-pole double-throw switch having a first contact point 67 and a second contact point 68. The first solenoid 55 and the first switch 54 are provided in a circuit coupled to the first contact point 67. The second solenoid 65 is provided in a circuit coupled to the second contact point 68.

The solenoid valve 25 and the atmosphere opening valve 42 of the present embodiment have the same configurations. Therefore, in the following description, the solenoid valve 25 will be described. Configurations shared with the atmosphere opening valve 42 are denoted by the same reference numerals and repetitive descriptions will be omitted.

The solenoid valve 25 includes an approximately disc-shaped valve body 71, a pressing member 72 and a valve spring 73 which push the valve body 71, and a first valve case 74*a* to a third valve case 74*c* that house the valve body 71. The first valve case 74*a* and the second valve case 74*b* support the valve body 71 in a manner of pinching an edge of the valve body 71. A valve chamber 75 is formed between the first valve case 74*a* and the valve body 71. The solenoid valve 25 includes the first solenoid 55 opening the solenoid valve 25 by pulling the pressing member 72. An inflow flow path 76 positioned upstream of the valve chamber 75 and an outflow flow path 77 downstream of the valve chamber 75 are provided in the first valve case 74*a*.

The valve chamber 75, the inflow flow path 76, and the outflow flow path 77 included in the solenoid valve 25 constitute a part of the liquid supply flow path 23. The valve chamber 75, the inflow channel 76, and the outflow channel 77 included in the atmosphere opening valve 42 constitute a part of the branching flow path 40.

The valve body 71 is formed of an elastically deformable material. An annular protrusion portion 71*a* is formed at the central portion of the valve body 71. The diameter of the protrusion portion 71*a* is longer than the diameter of the opening of the outflow flow path 77 formed in the valve chamber 75. The periphery of the opening of the outflow flow path 77 formed in the valve chamber 75 is a valve seat 78 with which the protrusion portion 71*a* of the valve body 71 in the solenoid valve 25 in a closed state contacts. The valve spring 73 pushes the valve body 71 through the pressing member 72 and pushes the protrusion portion 71*a* against the valve seat 78 to close the outflow flow path 77.

The first solenoid 55 switches between opening and closing of the solenoid spring 25. The solenoid valve 25 opens the liquid supply flow path 23 during energization and closes the liquid supply flow path 23 during de-energization. That is, the first solenoid 55 to which power is supplied pulls the pressing member 72 against the pressing force applied by the valve spring 73. The valve body 71 deforms by the pressure of the liquid, supplied under pressure, in the valve chamber 75 so as to be separated from the valve seat 78 and causes the valve chamber 75 and the outflow flow path 77 to communicate with each other. In this way, the solenoid valve 25 opens. If the power supply to the first solenoid 55 stops, the valve body 71 is pressed by the valve spring 73 to come into contact with the valve sear 78. In this way, the solenoid valve 25 closes.

The operation of the present embodiment will be described.

As shown in FIG. 2, when the liquid container 14 is coupled to the liquid supply flow path 23, the pressure in the pressurizing portion 24 is approximately equal to the atmospheric pressure. In this state, the first pressure chamber 44 is pressed by the first moving member 51 and the first pressing spring 52 and the volume of the first pressure chamber 44 shrinks. The first switch 54 is turned off and disconnects the power supply circuit 50. The second pressure chamber 46 is pressed by the second moving member 61 and the second pressing spring 62 and the volume of the second pressure chamber 46 shrinks. The second switch 64 comes into contact with the first contact point 67.

The first switch 54 is turned off so that no electricity flows through the first solenoid 55. The second switch 64 comes into contact with the first contact point 67 and does not contact with the second contact point 68 so that no electricity flows through the second solenoid 65. Therefore, the solenoid valve 25 is in a closed state where the liquid supply flow path 23 is closed. The atmosphere opening valve 42 is in a closed state where the inside of the pressurizing portion 24 is a space closed to the atmosphere.

Figure 3:
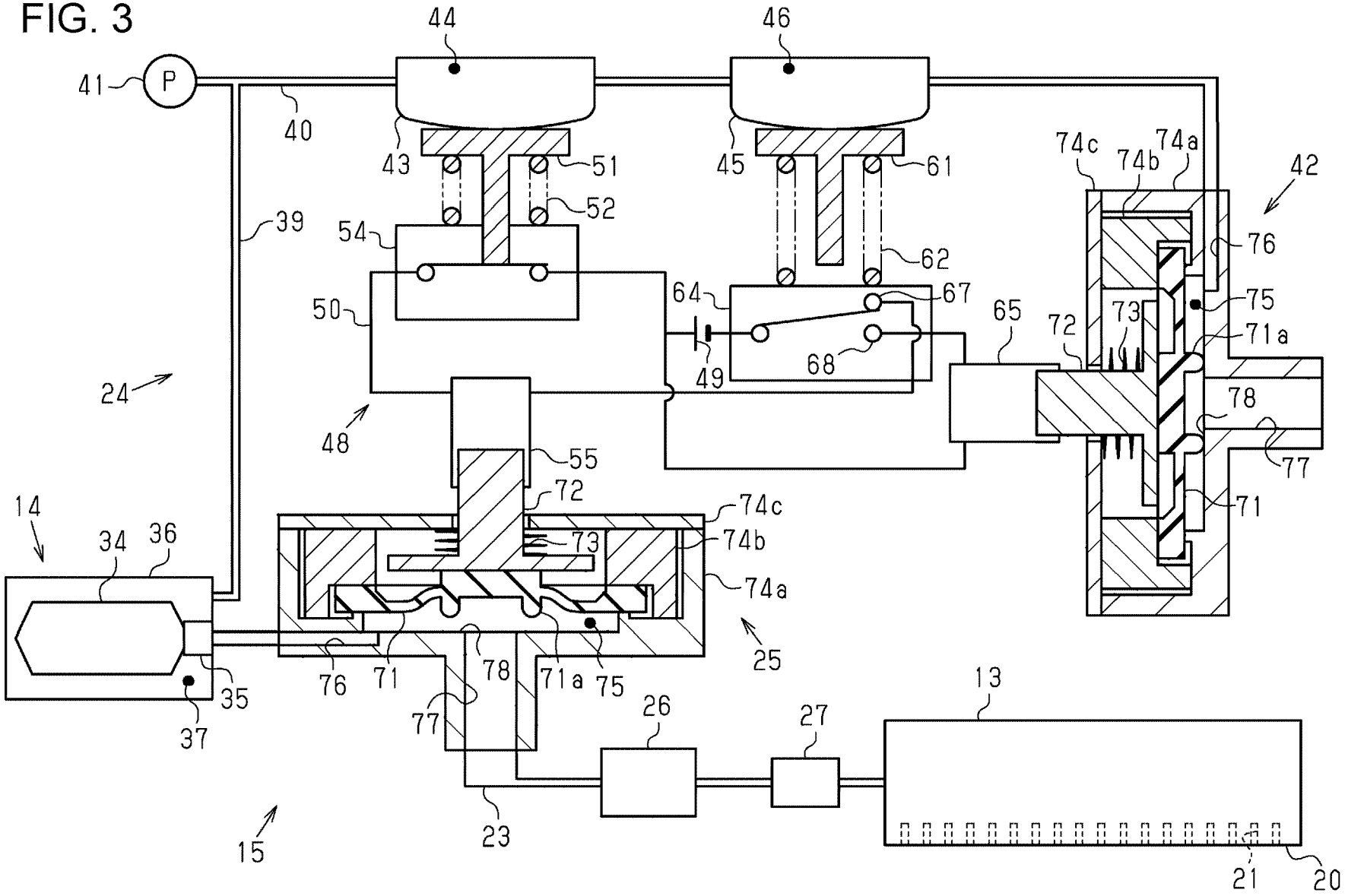
FIG. 3 is a schematic view of a liquid supply mechanism when the pressure in the pressurizing portion is equal to or higher than the supply pressure.

As shown in FIG. 3, if the air feeding pump 41 is driven, the pressure in the pressurizing portion 24 rises. The first displacing portion 43 is displaced to expand the volume of the first pressure chamber 44. The second displacing portion 45 is displaced to expand the volume of the second pressure chamber 46. The controller 19 drives the air feeding pump 41 in accordance with a printing operation in which the liquid ejecting head 13 ejects the liquid to print on the medium 17 or a maintenance operation in which the liquid ejecting head 13 is maintained.

If the pressure in the pressurizing portion 24 reaches a predetermined pressure, the first moving member 51 pressed by the first displacing portion 43 presses to turn off the first switch 54. The first switch 54 is coupled to the power supply circuit 50. The second switch 64 is in contact with the first contact point 67. Therefore, the power is supplied from the power supplying portion 49 to the first solenoid 55 and the solenoid valve 25 forcibly opens. At this time, the atmosphere opening valve 42 is closed.

Figure 4:
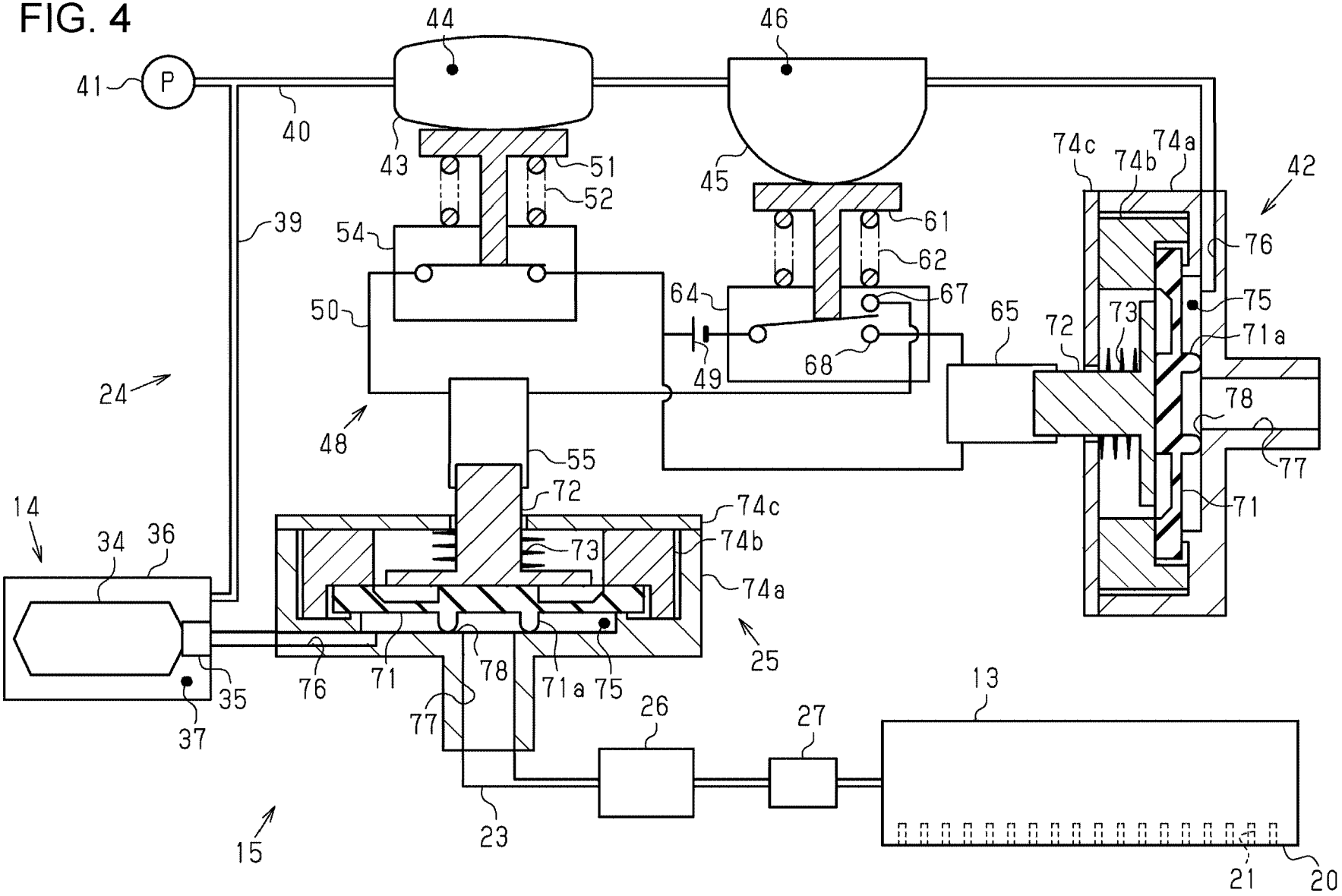
FIG. 4 is a schematic view of a liquid supply mechanism when the pressure in the pressurizing portion is equal to or higher than an excess pressure.

As shown in FIG. 4, when the pressure in the pressurizing portion 24 is higher than the predetermined pressure, the solenoid valve 25 in the open state is forcibly switched to a closed state by the displacement of the second displacing portion 45. The predetermined pressure in the present embodiment is equal to or higher than the supply pressure at which the first switch 54 is turned off and lower than the excess pressure at which the second switch 64 is separated from the first contact point 67. That the pressure in the pressurizing portion 24 is higher than the predetermined pressure means that the pressure in the pressurizing portion 24 is equal to or higher than the excess pressure.

If the second switch 64 is separated from the first contact point 67, the second switch 64 disconnects the power supply circuit 50. In this way, no electricity flows through the first solenoid 55 and the second solenoid 65. The solenoid valve 25 closes as the valve body 71 is pressed by the valve spring 73. The atmosphere opening valve 42 is closed.

Figure 5:
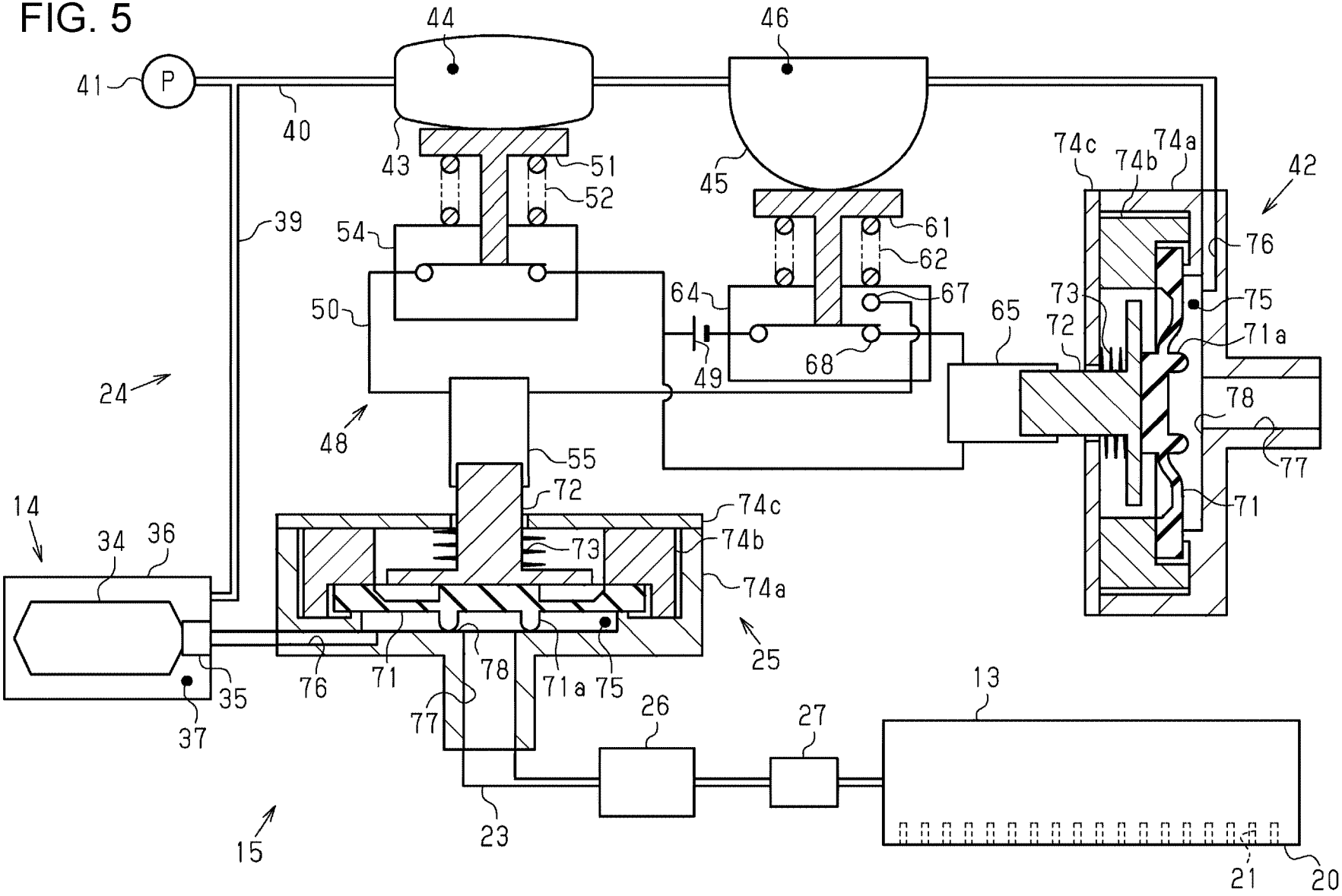
FIG. 5 is a schematic view of a liquid supply mechanism when the pressure in the pressurizing portion is a limit pressure.

As shown in FIG. 5, if the pressure in the pressurizing portion 24 rises to reach the limit pressure, the second switch 64 comes into contact with the second contact point 68. In this way, the power is supplied from the power supplying portion 49 to the second solenoid 65 and the atmosphere opening valve 42 opens. The atmosphere opening valve 42 in the open state allows the air in the pressurizing portion 24 to escape and the pressure in the pressurizing portion 24 falls. No electricity is supplied to the first solenoid 55 so that the solenoid valve 25 is closed.

The limit pressure is higher than the excess pressure. That is, the limit pressure is higher than the predetermined pressure. Therefore, when the pressure in the pressurizing portion 24 is higher than the predetermined pressure, the atmosphere opening valve 42 is switched from the closed state to the open state by the displacement of the second displacing portion 45.

As shown in FIG. 4, if the pressure in the pressurizing portion 24 falls, the volume of the first pressure chamber 44 and the second pressure chamber 46 shrinks. The second moving member 61 moves by the pressing force applied by the second pressing spring 62. If the pressure in the pressurizing portion 24 becomes lower than the limit pressure, the second switch 64 is separated from the second contact point 68. If no electricity is supplied to the second solenoid 65, the atmosphere opening valve 42 closes.

If a liquid leak in which liquid leaks from the liquid ejecting head 13 or the liquid supply mechanism 15, the liquid is supplied from the liquid container 14 by the leaked amount. The volume of the containing bag 34 shrinks by the amount of the supplied liquid. The controller 19 drives the air feeding pump 41 in accordance with the printing operation or the maintenance operation so that the pressure in the pressurizing portion 24 falls if the liquid leak occurs.

As shown in FIG. 2, when the pressure in the pressurizing portion 24 is lower than the predetermined pressure, the solenoid valve 25 in the open state is forcibly switched to the closed state by the displacement of the first displacing portion 43. That is, the open and closed states of the solenoid valve 25 are forcibly switched in accordance with the pressure change by the pressurizing portion 24. In other words, the open and closed states of the solenoid valve 25 are forcibly switched by the displacement of the first displacing portion 43.

Specifically, if the pressure in the pressurizing portion 24 is lower than the predetermined pressure and becomes lower than the supply pressure, the first moving member 51 is pressed to move by the first pressing spring 52 and turns off the first switch 54. No electricity is supplied through the first solenoid 55 so that the solenoid valve 25 closes. In this way, when a liquid leak occurs, the solenoid valve 25 in the open state forcibly is switched to the closed state by the first displacing portion 43 moving the first switch 54 to disconnect the power supply circuit 50.

The effect of the present embodiment will be described.

(1) The open and closed states of the solenoid valve 25 are forcibly switched in accordance with the pressure change of the pressurizing portion 24. Therefore, it is possible to forcibly close the solenoid valve 25 when the liquid leaks from the liquid ejecting head 13 or the like and a pressure change occurs, and it is possible to alleviate a concern that a large amount of liquid will leak.

(2) The open and closed states of the solenoid valve 25 are forcibly switched by the displacement of the first displacing portion 43 and the second displacing portion 45 included in the pressurizing portion 24. Therefore, it is possible to quickly open and close the solenoid valve 25 by a pressure change by the pressurizing portion 24.

(3) If the liquid leaks, the pressure in the liquid supply flow path 23 falls and the pressure in the pressurizing portion 24 pressurizing the inside of the liquid supply flow path 23 falls. At that point, the solenoid valve 25 in the open state is switched to the closed state when the pressure in the pressurizing portion 24 is lower than the predetermined pressure so that it is possible to alleviate a concern that the liquid continues to leak.

(4) The solenoid valve 25 in the open state is switched to the closed state when the pressure in the pressurizing portion 24 is higher than the predetermined pressure. Therefore, even when the pressure in the pressurizing portion 24 rises abnormally, it is possible to alleviate a concern that the liquid will leak.

(5) The atmosphere opening valve 42 in the closed state is switched to the open state when the pressure in the pressurizing portion 24 is higher than the predetermined pressure. Therefore, even when the pressure in the pressurizing portion 24 rises abnormally, it is possible to lower the pressure in the pressurizing portion 24.

(6) The first displacing portion 43 and the second displacing portion 45 move the first switch 54 and the second switch 64 so that the power supply circuit 50 for energizing the solenoid valve 25 is disconnected. Therefore, the solenoid valve 25 switches the energized state by the displacement of the first displacing portion 43 and it is possible to forcibly close the solenoid valve 25.

(7) Even when the air leaks from the pressurizing portion 24, the pressure in the pressurizing portion 24 and the liquid supply flow path 23 falls like when the liquid leak occurs. Therefore, even when the air leaks from the pressurizing portion 24, the liquid ejecting apparatus 11 can forcibly close the solenoid valve 25.

Second Embodiment

Next, a second embodiment of the liquid ejecting apparatus will be described with reference to the drawings. In the second embodiment, the positions where the first pressure chamber 44 and the second pressure chamber 46 are positioned are different from those of the first embodiment. The other points are almost the same as those of the first embodiment so that the same components are denoted by the same reference numerals and repetitive descriptions will be omitted.

Figure 6:
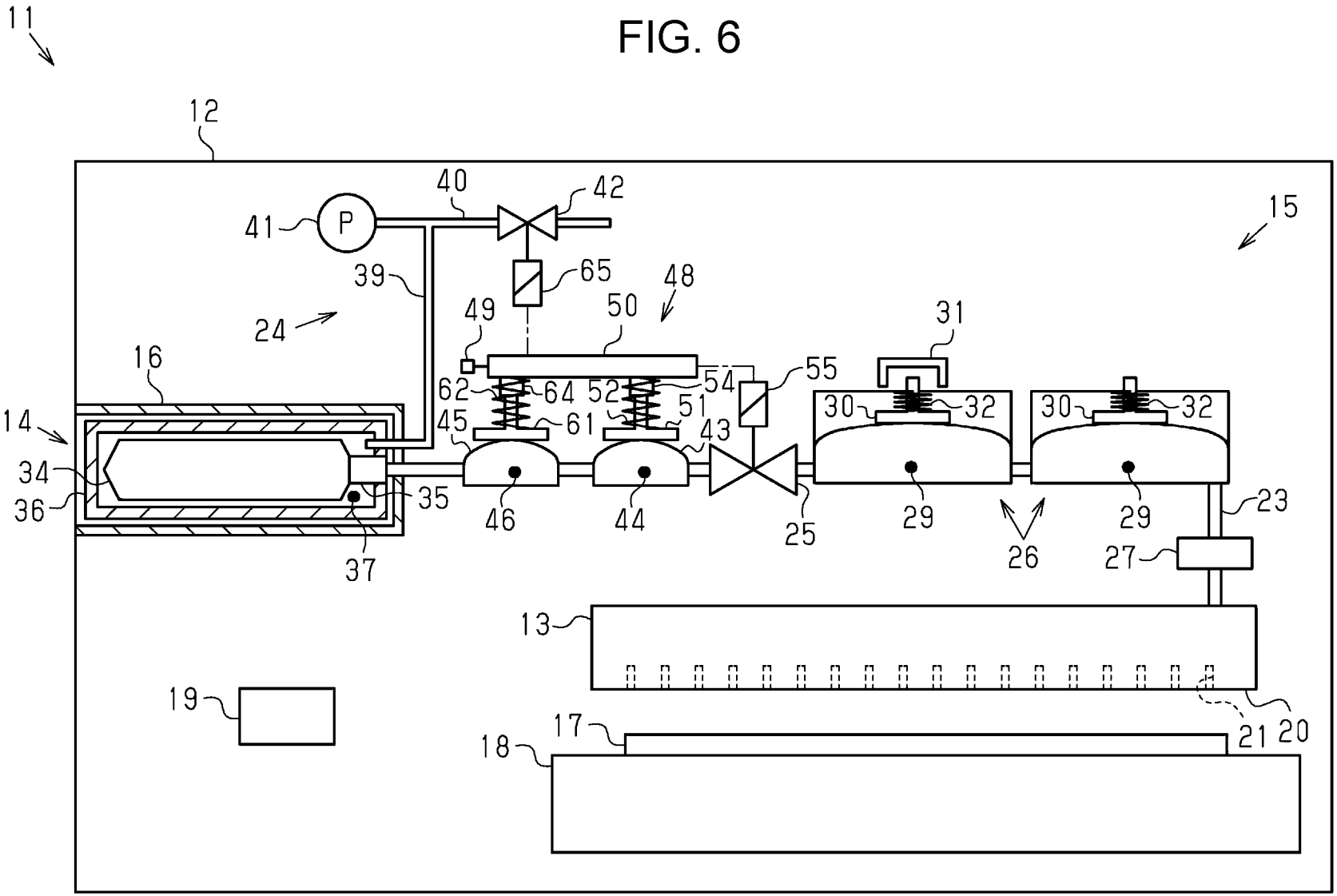
FIG. 6 is a schematic view of a liquid ejecting apparatus of a second embodiment.

As shown in FIG. 6, the first pressure chamber 44 and the second pressure chamber 46 of the present embodiment are provided in the liquid supply flow path 23 and constitute a part of the liquid supply flow path 23. The first pressure chamber 44, the second pressure chamber 46, and the solenoid valve 25 are provided upstream of the pressure adjustment valve 27 in the liquid supply flow path 23.

The first displacing portion 43 constitutes a part of a wall surface of the first pressure chamber 44. The second displacing portion 45 constitutes a part of a wall surface of the second pressure chamber 46. That is, the liquid supply flow path 23 includes a first displacing portion 43 and a second displacing portion 45 configured to be displaced in accordance with a pressure change in the liquid supply flow path 23 pressurized by the pressurizing portion 24.

The operation of the present embodiment will be described.

Figure 7:
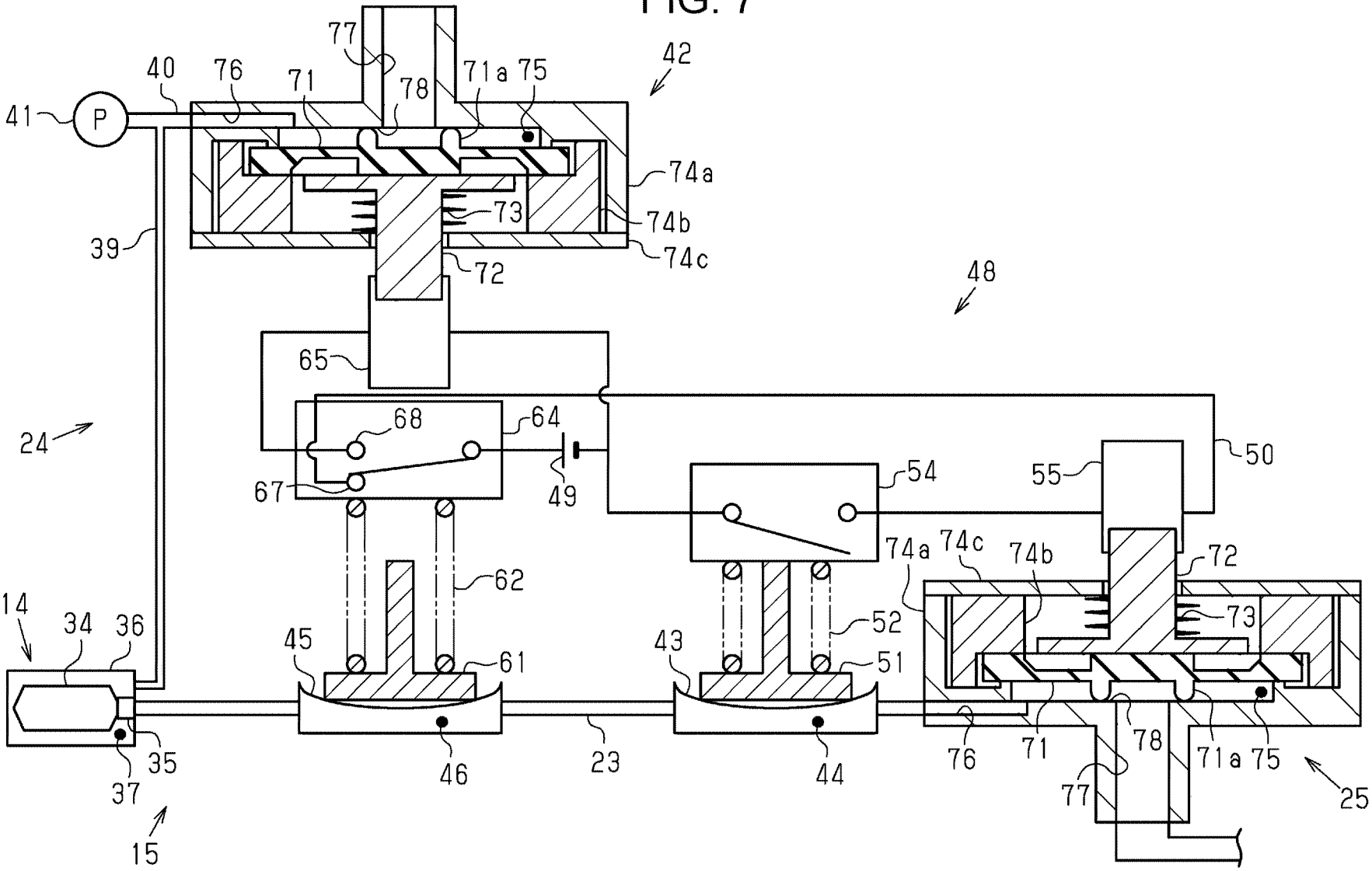
FIG. 7 is a schematic view of a liquid supply mechanism when the pressure in a liquid supply flow path is lower than the supply pressure.

As shown in FIG. 7, in a state where the pressure in the liquid supply flow path 23 is lower than the predetermined pressure, the solenoid valve 25 closes, and the atmosphere opening valve 42 is closed.

Figure 8:
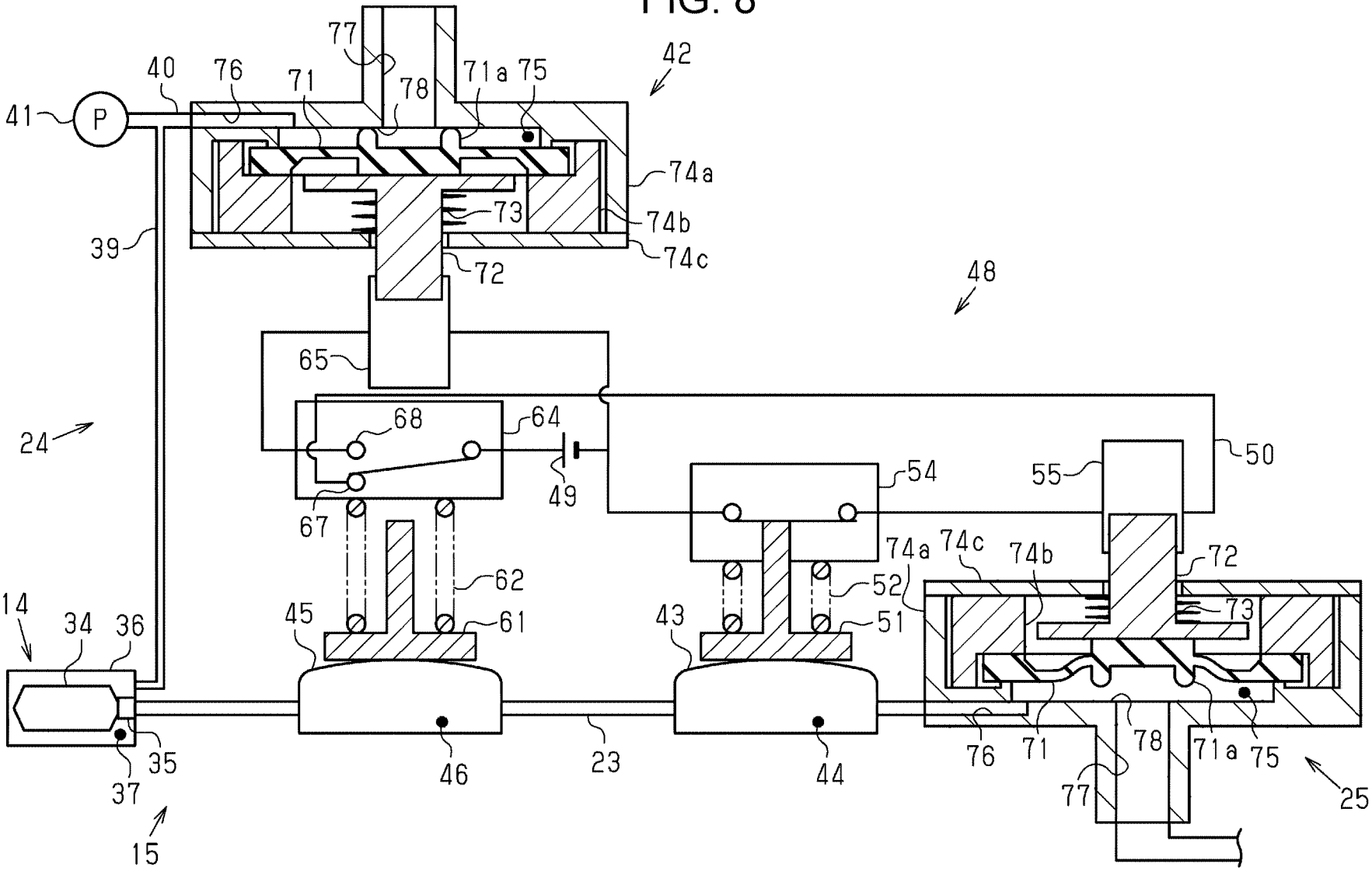
FIG. 8 is a schematic view of a liquid supply mechanism when the pressure in a liquid supply flow path is equal to or higher than the supply pressure.

As shown in FIG. 8, if the air feeding pump 41 is driven, the pressure in the pressurizing portion 24 rises and the pressure in the liquid supply flow path 23 upstream of the pressure adjustment valve 27 rises. The first displacing portion 43 is displaced to expand the volume of the first pressure chamber 44. The second displacing portion 45 is displaced to expand the volume of the second pressure chamber 46.

If the pressure in the liquid supply flow path 23 reaches the predetermined pressure, the first moving member 51 pressed by the first displacing portion 43 turns on the first switch 54. The first switch 54 is coupled to the power supply circuit 50. The second switch 64 is in contact with the first contact point 67. Therefore, the power is supplied from the power supplying portion 49 to the first solenoid 55 and the solenoid valve 25 forcibly opens. At this time, the atmosphere opening valve 42 is closed.

Figure 9:
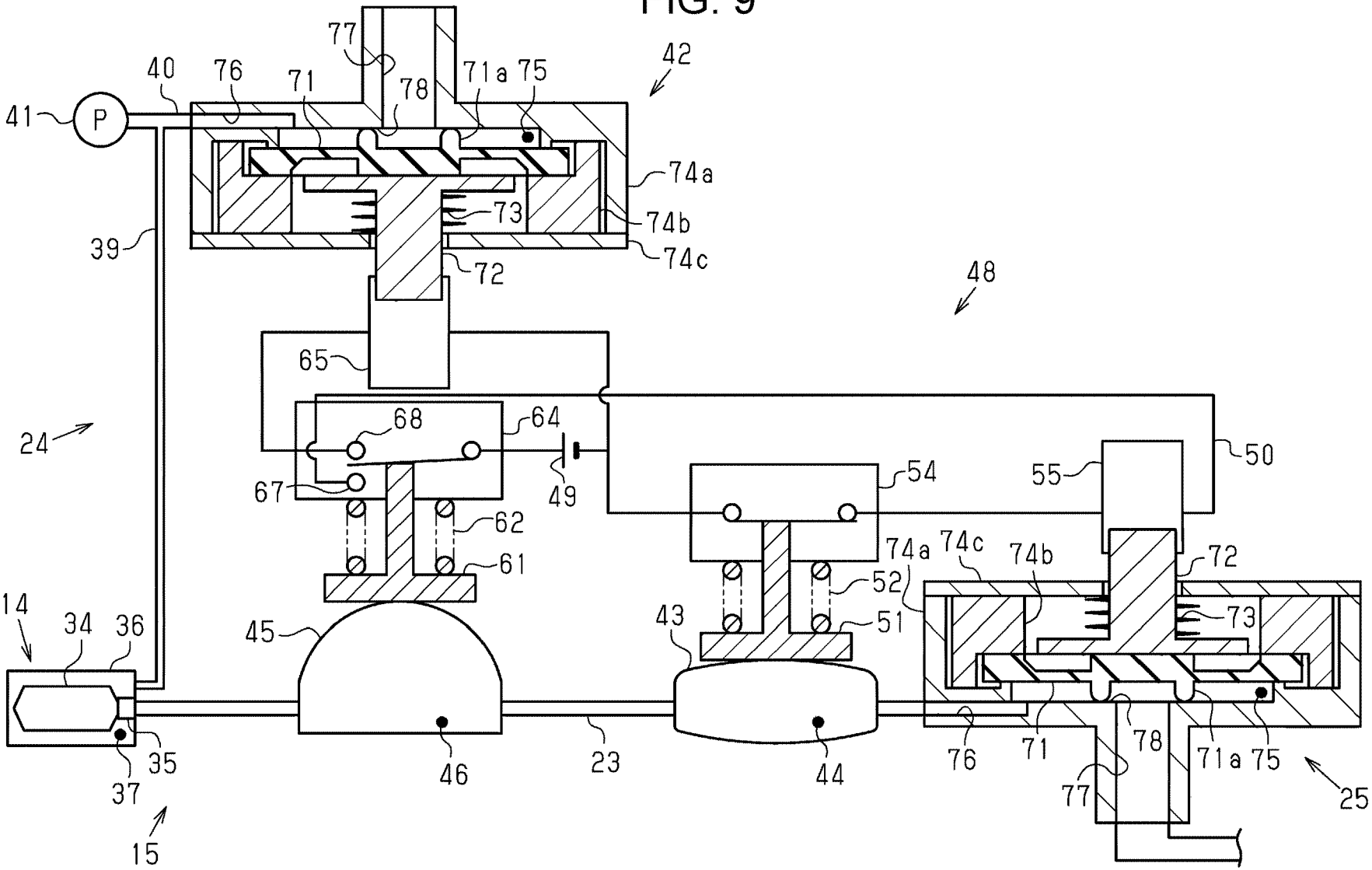
FIG. 9 is a schematic view of a liquid supply mechanism when the pressure in a liquid supply flow path is equal to or higher than the excess pressure.

As shown in FIG. 9, when the pressure in the liquid supply flow path 23 is higher than the predetermined pressure, the solenoid valve 25 in the open state is forcibly switched to the closed state by the displacement of the second displacing portion 45. That is, if the pressure in the liquid supply flow path 23 is higher than the excess pressure, the second switch 64 is separated from the first contact point 67 and the second switch 64 disconnects the power supply circuit 50. In this way, no electricity flows through the first solenoid 55 and the second solenoid 65. The solenoid valve 25 closes. The atmosphere opening valve 42 is closed.

Figure 10:
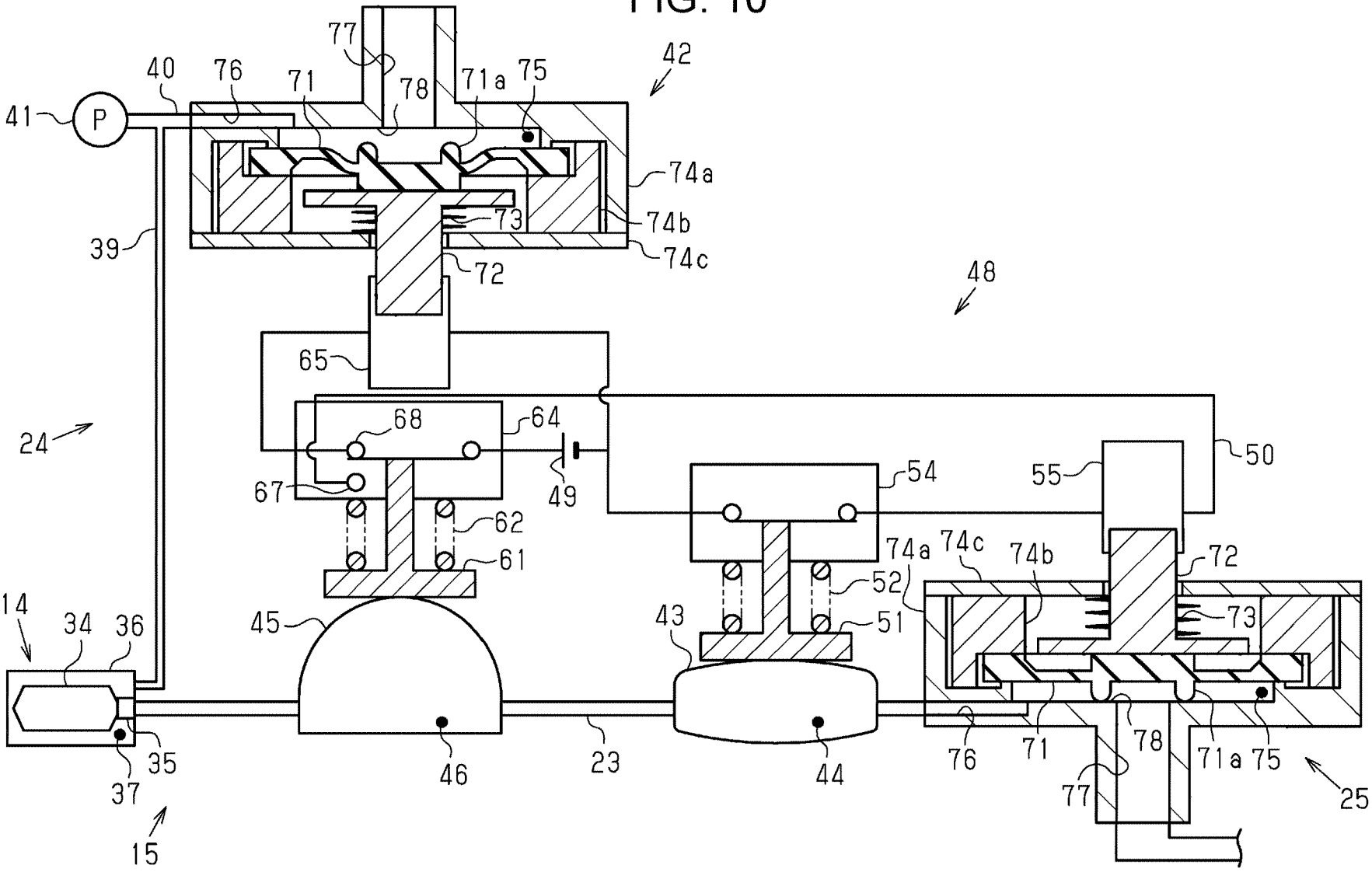
FIG. 10 is a schematic view of a liquid supply mechanism when the pressure in a liquid supply flow path is the limit pressure.

As shown in FIG. 10, if the pressure in the liquid supply flow path 23 rises to reach the limit pressure, the second switch 64 comes into contact with the second contact point 68. In this way, the power is supplied from the power supplying portion 49 to the second solenoid 65 and the atmosphere opening valve 42 is opened. The atmosphere opening valve 42 in the open state allows the air in the pressurizing portion 24 to escape and the pressure in the pressurizing portion 24 falls. No electricity is supplied to the first solenoid 55 so that the solenoid valve 25 is closed.

The limit pressure is higher than the excess pressure. That is, the limit pressure is higher than the predetermined pressure. Therefore, when the pressure in the liquid supply flow path 23 is higher than the predetermined pressure, the atmosphere opening valve 42 is switched from the closed state to the open state by the displacement of the second displacing portion 45.

As shown in FIG. 9, if the atmosphere opening valve 42 opens and the pressure in the pressurizing portion 24 falls, the pressure in the liquid supply flow path 23 falls. The volume of the first pressure chamber 44 and the second pressure chamber 46 shrinks. The second moving member 61 moves by the pressing force applied by the second pressing spring 62. If the pressure in the liquid supply flow path 23 falls below the limit pressure, the second switch 64 is separated from the second contact point 68. If no electricity is supplied to the second solenoid 65, the atmosphere opening valve 42 closes.

As shown in FIG. 7, if a liquid leak occurs in the liquid ejecting head 13 or the liquid supply mechanism 15, the pressure in the liquid supply flow path 23 falls by the amount of the leaked liquid. When the pressure in the liquid supply flow path 23 is lower than the predetermined pressure, the solenoid valve 25 in the open state is forcibly switched to the closed state by the displacement of the first displacing portion 43. That is, the open and closed states of the solenoid valve 25 are forcibly switched in accordance with the pressure change of the liquid supply flow path 23 by the pressurizing portion 24. In other words, the open and closed states of the solenoid valve 25 are forcibly switched by the displacement of the first displacing portion 43.

Specifically, if the pressure in the liquid supply flow path 23 is lower than the predetermined pressure to be less than the supply pressure, the first moving member 51 is pressed by the first pressing spring 52 to move and turns off the first switch 54. No electricity is supplied through the first solenoid 55, so that the solenoid valve 25 closes. In this way, when a liquid leak occurs, the solenoid valve 25 in the open state is forcibly switched to the closed state by the first displacing portion 43 moving the first switch 54 to disconnect the power supply circuit 50.

The effect of the present embodiment will be described.

(8) The open and closed states of the solenoid valve 25 are forcibly switched by the displacement of the first displacing portion 43 and the second displacing portion 45 included in the liquid supply flow path 23. Therefore, it is possible to close the solenoid valve 25 by a pressure change in the vicinity of the solenoid valve 25 provided in the liquid supply flow path 23.

(9) If the liquid leaks, the pressure in the liquid supply flow path 23 falls. At that point, the solenoid valve 25 in the open state is switched to the closed when the pressure in the liquid supply flow path 23 is lower than the predetermined pressure so that it is possible to alleviate a concern that the liquid continues to leak.

(10) The solenoid valve 25 in the open state is switched to the closed state when the pressure in the liquid supply flow path 23 is higher than the predetermined pressure. Therefore, even when the pressure in the liquid supply flow path 23 rises abnormally, it is possible to alleviate a concern that the liquid will leak from the liquid ejecting head 13 or the like.

(11) When the pressure in the pressurizing portion 24 rises abnormally, the pressure in the liquid supply flow path 23 also rises. At that point, the atmosphere opening valve 42 in the closed state is switched to the open state when the pressure in the liquid supply flow path 23 is higher than the predetermined pressure. Therefore, it is possible to lower the pressure in the pressurizing portion 24 and it is possible to alleviate a concern that the pressure in the liquid supply flow path 23 will rise excessively.

It is possible to implement the present embodiment with the following modifications. It is possible to implement the present embodiment and the following modification examples in combination with each other within a technically consistent range.

Figure 11:
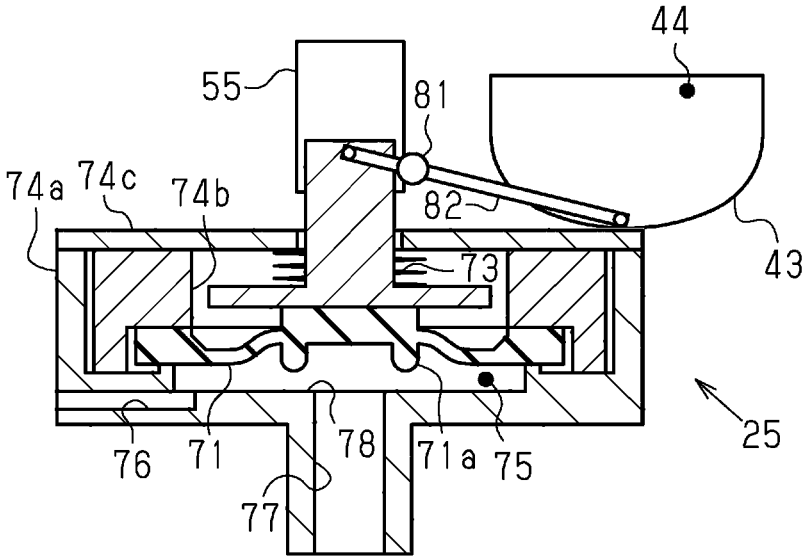
FIG. 11 is a schematic view showing an open state of a solenoid valve of a modification example.
Figure 12:
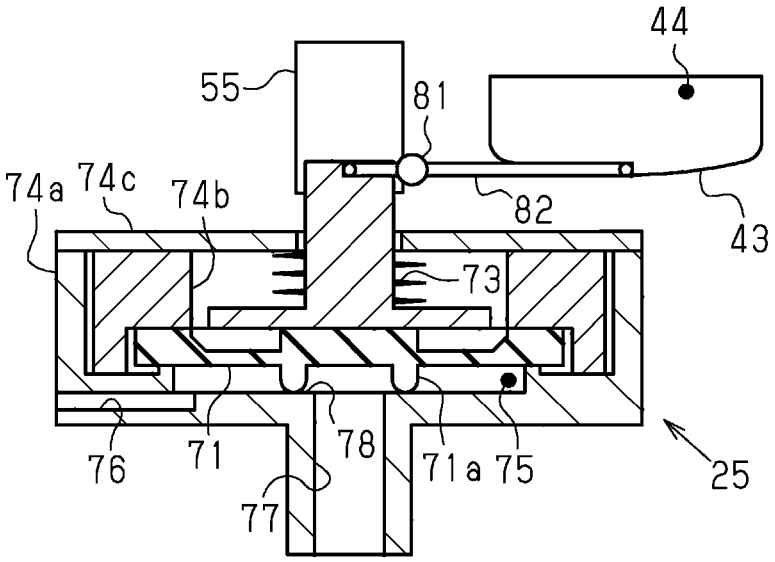
FIG. 12 is a schematic view showing a closed state of a solenoid valve of a modification example.

As shown in FIGS. 11 and 12, in the liquid ejecting apparatus 11, the first displacing portion 43 can move the valve body 71 of the solenoid valve 25. In this way, the solenoid valve 25 in the open state may be forcibly switched to the closed state. The first displacing portion 43 moves the valve body 71 of the solenoid valve 25 so that, in addition to the electric opening/closing, the physical opening/closing is made possible in the solenoid valve 25. Therefore, it is possible to enhance the reliability of the solenoid valve 25. That is, the solenoid valve 25 may be configured to open and close by the first solenoid 55 and open and close by a physical movement of the valve body 71 in a state where power is not supplied to the first solenoid 55. For example, the liquid ejecting apparatus 11 includes a lever 82 pivoting around an axis 81. A first end of the lever 82 is pivotably attached to the first displacing portion 43 and a second end across from the first end is pivotably attached to the pressing member 72 fixed to the valve body 71. As shown in FIG. 11, when the pressure in the pressurizing portion 24 or the liquid supply flow path 23 reaches the predetermined pressure, the first displacing portion 43 may open the solenoid valve 25 by pressing down the lever 82. As shown in FIG. 12, when the pressure in the pressurizing portion 24 or the liquid supply flow path 23 is lower than the predetermined pressure, the first displacing portion 43 may close the solenoid valve 25 by pressing up the lever 82. The first displacing portion 43 may be a piston moving by the pressure of the first pressure chamber 44.

Figure 13:
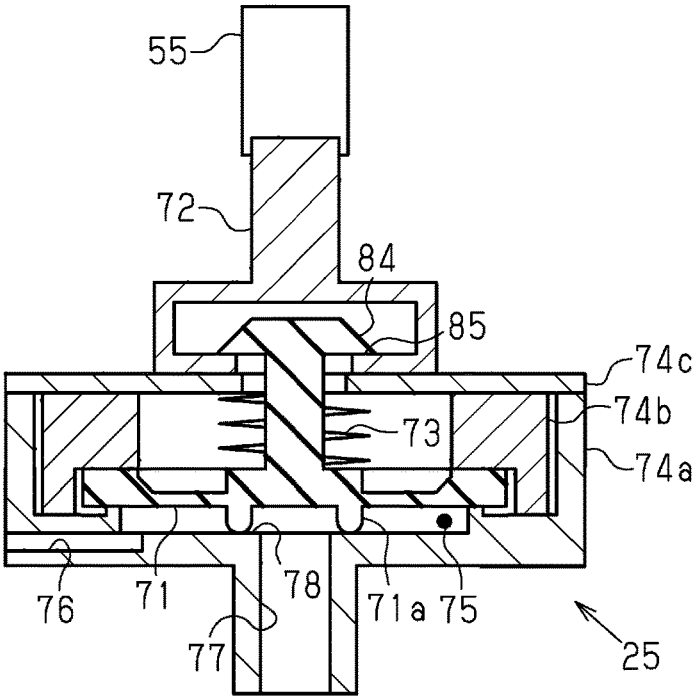
FIG. 13 is a schematic view showing a closed state of a solenoid valve of a modification example.
Figure 14:
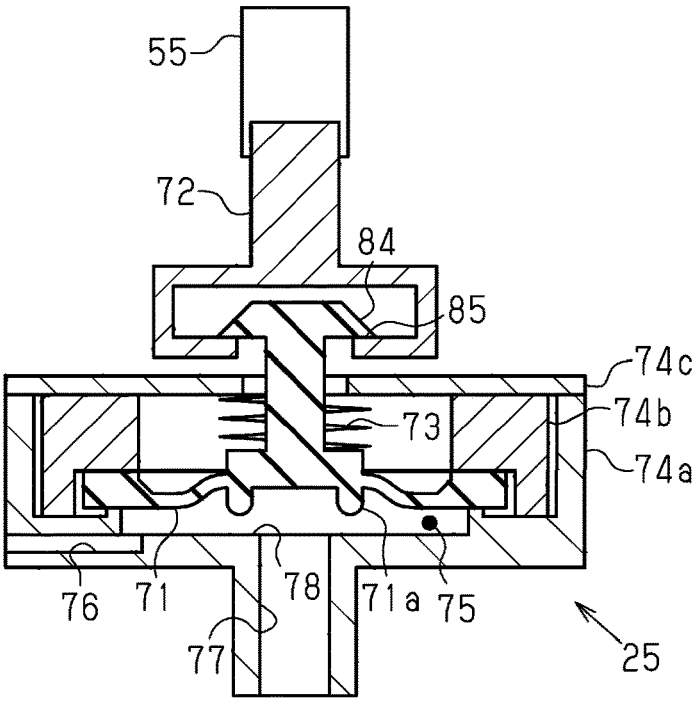
FIG. 14 is a schematic view showing an open state of a solenoid valve of a modification example.

As shown in FIGS. 13 and 14, the valve body 71 may be provided with a flange 84. The pressing member 72 may include an engaging portion 85 engaging with the flange 84. The solenoid valve 25 may separate the valve body 71 from the valve seat 78 such that the engaging portion 85 lifts the flange 84 when the pressing member 72 moves during energization.

The solenoid valve 25 may be provided, between the valve body 71 and the pressing member 72, with a spring pressing the valve body 71 against the pressing member 72. If the strength of this spring is weaker than the strength of the valve spring 73 and the pressure in the liquid supply flow path 23 is equal to or higher than the supply pressure so that the valve body 71 is separated from the valve seat 78, it is possible to close the solenoid valve 25 when the pressure in the liquid supply flow path 23 is lower than the predetermined pressure.

The atmosphere opening valve 42 may open and close under the control of the controller 19. A user may operate to open and close the atmosphere opening valve 42. In this case, the liquid ejecting apparatus 11 may be configured not to include the second pressure chamber 46 and the second displacing portion 45.

The controller 19 may control to open and lose the solenoid valve 25 when the pressure in the pressurizing portion 24 and the liquid supply flow path 23 reaches the predetermined pressure. For example, the controller 19 may open the solenoid valve 25 when a predetermined amount of the liquid reserved in the reservoir 29 is consumed or may open the solenoid valve 25 when the amount of liquid reserved in the reservoir 29 based on the measurement result of the detecting portion 31 is less than the amount of liquid to be used in the next printing. The controller 19 may close the solenoid valve 25 after a certain time elapses since the solenoid valve 25 opened. The time for maintaining the solenoid valve 25 in the open state is the time required to fill the reservoir 26 with liquid. While the solenoid valve 25 is closed, the liquid reserved in the reservoir 26 is supplied to the liquid ejecting head 13. The controller 19 may calculate the amount of liquid reserved in the reservoir 29 from the number of liquid droplets ejected from the liquid ejecting head 13.

The liquid ejecting apparatus 11 may include a sensor detecting the opening/closing of the solenoid valve 25. The controller 19 may determine that the solenoid valve 25 failed when the detection result of the sensor and the opening/closing command of the solenoid valve 25 do not match.

The second switch 64 may be a single-pole single-throw switch like the first switch 54. That is, the second switch 64 may be configured not to include the first contact point 67. The liquid ejecting apparatus 11 may maintain the solenoid valve 25 in the open state even when the pressure in the pressurizing portion 24 or the liquid supply flow path 23 is higher than the predetermined pressure. The liquid ejecting apparatus 11 may separately include a circuit in which the first switch 54 and the first solenoid 55 are coupled to each other and a circuit in which the second switch 64 and the second solenoid 65 are coupled to each other.

The pressurizing portion 24 may crush the containing bag 34 from the outside with a plate or a weight pinching the containing bag 34 to pressurize the liquid supply flow path 23.

When the first pressure chamber 44 and the second pressure chamber 46 are provided in the liquid supply flow path 23, instead of the air feeding pump 41, a pump pressing the liquid, sucked from upstream, downstream may be provided upstream of the second pressure chamber 46 of the liquid supply flow path 23. Further, in this case, the configuration may be such that the second pressure chamber 46, the second switch 64, and the second displacing portion 45 are not included.

In the liquid ejecting apparatus 11, the solenoid valve 25 may be switched to the closed state when the pressure in the pressurizing portion 24 or the liquid supply flow path 23 is higher than the predetermined pressure and the solenoid valve 25 may be switched to the open state when the pressure in the pressurizing portion 24 or the liquid supply flow path 23 is lower than the predetermined pressure. That is, the liquid ejecting apparatus 11 may be configured not to include the first switch 54, the first pressure chamber 44, and the first displacing portion 43.

The liquid ejecting apparatus 11 may eject or discharge a liquid other than ink. The state of the liquid which is formed into a minute amount of droplet and ejected from the liquid ejecting apparatus also includes granules, tears, or threads in tailing shapes. The liquid referred to here will do as long as the liquid can be discharged from the liquid ejecting apparatus. For example, the liquid will do as long as the substance is in a liquid phase, and may include fluids such as a liquid have high or low viscosity, sol, gel water, other inorganic solvents, organic solvents, solutions, resins in a liquid state, metals in a liquid state, and metal melt. The liquid includes not only a liquid as one state of a substance but also a liquid into which functional material particles made of solid materials such as pigments or metal particles are dissolved, dispersed or mixed in a solvent. A typical example of the liquid includes ink as described in the above embodiment, liquid crystal, or the like. Here, the ink includes general water-based ink, oil-based ink, and various liquid compositions such as gel ink, hot melt ink, or the like. A specific example of the liquid ejection apparatus is an apparatus discharging a liquid containing a material, in a dispersed or dissolved form, such as an electrode material and a coloring material used in manufacturing a liquid crystal display, an electroluminescence display, a surface light emitting display, a color filter, and the like. The liquid ejecting apparatus may be an apparatus discharging a bio-organic material used in manufacturing a biochip, an apparatus discharging a liquid to be a sample used in a precision pipette, a printing apparatus, or a micro dispenser. The liquid ejecting apparatus may be an apparatus discharging a lubricant onto a precision machine such as a watch or a camera with pinpoint accuracy, or an apparatus discharging a transparent resinous liquid such as a ultra-violate curing resin onto a substrate to form a micro-hemispherical lens, an optical lens, or the like used in an optical communication element. The liquid ejecting apparatus may be an apparatus discharging an etching solution such as acid or alkali to etch a substrate or the like.

Technical ideas and operational effects thereof grasped from the above embodiments and the modification examples will be described below.

The liquid ejecting apparatus includes a liquid ejecting head configured to eject a liquid, a liquid supply flow path configured to supply a liquid from a liquid container containing the liquid to the liquid ejection head, a pressurizing portion pressurizing the inside of the liquid supply flow path, and a solenoid valve which is provided in the liquid supply flow path and which opens the liquid supply flow path during energization and closes the liquid supply flow path during de-energization. The open and closed states of the solenoid valve are forcibly switched in accordance with a pressure change in the pressurizing portion.

According to this configuration, the open and closed states of the solenoid valve are forcibly switched in accordance with a pressure change by the pressurizing portion. Therefore, when the liquid leaks from the liquid ejecting head or the like and a pressure change occurs, it is possible to forcibly close the solenoid valve and it is possible to alleviate a concern that a large amount of liquid leaks.

In the liquid ejecting apparatus, the pressurizing portion has a displacing portion which pressurizes the inside of the liquid supply flow path with air and which is configured to be displaced in accordance with a pressure change and the open and closed states of the solenoid valve may be forcibly switched by the displacement of the displacing portion.

According to this configuration, the open and closed states of the solenoid valve are forcibly switched by the displacement of the displacing portion included in the pressurizing portion. Therefore, it is possible to quickly open and close the solenoid valve by a pressure change by the pressurizing portion.

In the liquid ejecting apparatus, when the pressure in the pressurizing portion is lower than the predetermined pressure, the solenoid valve in the open state may be forcibly switched to the closed state by the displacement of the displacing portion.

If the liquid leaks, the pressure in the liquid supply flow path falls and the pressure in the pressurizing portion pressurizing the inside of the liquid supply flow path falls. At that point, according to this configuration, the solenoid valve in the open state is switched to the closed state when the pressure in the pressurizing portion is lower than the predetermined pressure so that it is possible to alleviate a concern that the liquid will continue to leak.

When the pressure in the pressurizing portion is higher than the predetermined pressure, the liquid ejecting apparatus in the open state may be forcibly switched to the closed state by the displacement of the displacing portion.

According to this configuration, when the pressure in the pressurizing portion is higher than the predetermined pressure, the solenoid valve in the open state is switched to the closed state. Therefore, even when the pressure in the pressurizing portion rises abnormally, it is possible to alleviate a concern that the liquid will leak.

The liquid ejecting apparatus includes an atmosphere opening valve configured to communicate the inside of the pressurizing portion with the atmosphere and the atmosphere opening valve may be switched from the closed state to the open state by the displacement of the displacing portion when the pressure in the pressurizing portion is higher than the predetermined pressure.

According to this configuration, the atmosphere opening valve in the closed state is switched to the open state when the pressure in the pressurizing portion is higher than the predetermined pressure. Therefore, when the pressure in the pressurizing portion rises abnormally, it is possible to lower the pressure in the pressurizing portion.

In the liquid ejecting apparatus, the liquid supply flow path has a displacing portion configured to be displaced in accordance with a pressure change in the liquid supply flow path pressurized by the pressurizing portion and the open and closed states of the solenoid valve may be forcibly switched by the displacement of the displacing portion.

According to this configuration, the open and closed states of the solenoid valve are forcibly switched by the displacement of the displacing portion included in the liquid supply flow path. Therefore, it is possible to close the solenoid valve by the pressure change in the vicinity of the solenoid valve provided in the liquid supply flow path.

In the liquid ejecting apparatus, when the pressure in the liquid supply flow path is lower than the predetermined pressure, the solenoid valve in the open state may be forcibly switched to the closed state by the displacement of the displacing portion.

If the liquid leaks, the pressure in the liquid supply flow path falls. At that point, according to this configuration, when the pressure in the liquid supply flow path is lower than the predetermined pressure, the solenoid valve in the open state is switched to the closed state so that it is possible to alleviate a concern that the liquid will continue to leak.

In the liquid ejecting apparatus, when the pressure in the liquid supply flow path is higher than the predetermined pressure, the solenoid valve in the open state may be forcibly switched to the closed state by the displacement of the displacing portion.

According to this configuration, when the pressure in the liquid supply flow path is higher than the predetermined pressure, the solenoid valve in the open state is switched to the closed state. Therefore, even when the pressure in the liquid supply flow path rises abnormally, it is possible to alleviate a concern that the liquid will leak from the liquid ejecting head or the like.

The liquid ejecting apparatus further includes an atmosphere opening valve configured to communicate the inside of the pressurizing portion, which pressurizes the inside of the liquid supply flow path with air, with the atmosphere, and when the pressure in the liquid supply flow path is higher than the predetermined pressure, the atmosphere opening valve may be switched from the closed state to the open state by the displacement of the displacing portion.

When the pressure in the pressurizing portion rises, the pressure in the liquid supply flow path also rises. At that point, according to this configuration, when the pressure in the liquid supply flow path is higher than the predetermined pressure, the atmosphere opening valve in the closed state is switched to the open state. Therefore, it is possible to lower the pressure in the pressurizing portion and it is possible to alleviate a concern that the pressure in the liquid supply flow path will rise excessively.

The liquid ejecting apparatus further includes a power supply circuit for energizing the solenoid valve, the power supply circuit has a switch switching between a connection and a disconnection of the power supply circuit, and the displacing portion moves the switch to disconnect the power supply circuit so that the solenoid valve in the open state may be forcibly switched to the closed state.

According to this configuration, the displacing portion moves the switch to disconnect the power supply circuit for energizing the solenoid valve. Therefore, the energizing state of the solenoid valve is switched by the displacement of the displacing portion and it is possible to forcibly close the solenoid valve.

In the liquid ejection apparatus, the displacing portion moves the valve body of the solenoid valve so that the solenoid valve in the open state may be forcibly switched to the closed state.

According to this configuration, the displacing portion moves the valve body of the solenoid valve so that, in addition to the electric opening/closing, the physical opening/closing is made possible in the solenoid valve. Therefore, it is possible to enhance the reliability of the solenoid valve.

What is claimed is:

1. A liquid ejecting apparatus comprising:

a liquid ejecting head configured to eject a liquid;

a liquid supply flow path configured to supply the liquid from a liquid container containing the liquid to the liquid ejecting head;

a pressurizing portion pressurizing an inside of the liquid supply flow path;

a solenoid valve which is provided in the liquid supply flow path and which opens the liquid supply flow path during energization and closes the liquid supply flow path during de-energization; and a power supply circuit for energizing the solenoid valve, wherein the pressurizing portion has a displacing portion configured to be displaced in accordance with a pressure change, the power supply circuit has a switch switching between a connection and a disconnection of the power supply circuit, and the displacing portion moves the switch to disconnect the power supply circuit so that the solenoid valve in open state is forcibly switched to closed state.

2. The liquid ejecting apparatus according to claim 1, wherein the pressurizing portion pressurizes the inside of the liquid supply flow path with air.

3. The liquid ejecting apparatus according to claim 1, wherein the solenoid valve in the open state is forcibly switched to the closed state by the displacement of the displacing portion when a pressure in the pressurizing portion is lower than a predetermined pressure.

4. The liquid ejecting apparatus according to claim 1, wherein the solenoid valve in the open state is forcibly switched to the closed state by the displacement of the displacing portion when a pressure in the pressurizing portion is higher than a predetermined pressure.

5. The liquid ejecting apparatus according to claim 1, further comprising:

an atmosphere opening valve configured to communicate an inside of the pressurizing portion with atmosphere, wherein the atmosphere opening valve is switched from a closed state to an open state by the displacement of the displacing portion when the pressure in the pressurizing portion is higher than a predetermined pressure.

6. A liquid ejecting apparatus comprising:

a liquid ejecting head configured to eject a liquid;

a liquid supply flow path configured to supply the liquid from a liquid container containing the liquid to the liquid ejecting head;

a pressurizing portion pressurizing an inside of the liquid supply flow path;

a solenoid valve which is provided in the liquid supply flow path and which opens the liquid supply flow path during energization and closes the liquid supply flow path during de-energization; and a power supply circuit for energizing the solenoid valve, wherein the liquid supply flow path has a displacing portion configured to be displaced in accordance with a pressure change in the liquid supply flow path pressurized by the pressurizing portion, the power supply circuit has a switch switching between a connection and a disconnection of the power supply circuit, and the displacing portion moves the switch to disconnect the power supply circuit so that the solenoid valve in open state is forcibly switched to closed state.

7. The liquid ejecting apparatus according to claim 6, wherein the solenoid valve in the open state is forcibly switched to the closed state by the displacement of the displacing portion when the pressure in the liquid supply flow path is lower than a predetermined pressure.

8. The liquid ejecting apparatus according to claim 6, wherein the solenoid valve in the open state is forcibly switched to the closed state by the displacement of the displacing portion when the pressure in the liquid supply flow path is higher than a predetermined pressure.

9. The liquid ejecting apparatus according to claim 6, further comprising:

an atmosphere opening valve configured to communicate the inside of the pressurizing portion, which pressurizes the inside of the liquid supply flow path with air, with atmosphere, wherein the atmosphere opening valve is switched from the closed state to the open state by the displacement of the displacing portion when the pressure in the liquid supply flow path is higher than a predetermined pressure.

* * * * *